United States Patent [19]

Yamana et al.

[11] 4,396,370

[45] Aug. 2, 1983

[54] COMBUSTION SAFETY APPARATUS

[75] Inventors: Toshifumi Yamana, Kasugai; Minoru Oguri, Gifu; Toshinari Morita, Aichi, all of Japan

[73] Assignee: Rinnai Kabushiki Kaisha, Aichi, Japan

[21] Appl. No.: 210,030

[22] Filed: Nov. 24, 1980

[30] Foreign Application Priority Data

Nov. 30, 1979 [JP] Japan ..... 54-154429

[51] Int. Cl.[3] ..... F23N 5/10

[52] U.S. Cl. ..... 431/80; 431/76

[58] Field of Search ..... 431/76, 80, 75, 78

[56] References Cited

U.S. PATENT DOCUMENTS 3,941,553 3/1976 Bedford ..... 431/80
4,125,356 11/1978 Ohashi et al. ..... 431/76
4,147,494 4/1979 Ando et al. ..... 431/80

FOREIGN PATENT DOCUMENTS 54-47138 4/1979 Japan ..... 431/80

*Primary Examiner*—Edward G. Favors

*Attorney, Agent, or Firm*—Armstrong, Nikaido, Marmelstein & Kubovcik

[57] ABSTRACT

A combustion safety arrangement in which a switch is connected in an electrical power circuit for an electromagnetic valve in a fuel passage. A combustion detecting element responds to a change of a flame caused by incomplete combustion or the like, and generates a signal or change in an electrical characteristic. The switch and the combustion detecting element are interconnected through a control circuit which has a level detector for detecting a predetermined level of the change in electrical characteristics. The arrangement is such that the switch may be opened by the predetermined level of the change in electrical characteristics. The control circuit has a time limit operation circuit so that only when the generation of the change in electrical characteristic is continued for a delayed time set by that time limit operation circuit, the switch may be opened. A timer circuit included in the control circuit is provided with a condenser which is charged through a resistance by closing a power switch in the electrical power circuit.

4 Claims, 3 Drawing Figures

COMBUSTION SAFETY APPARATUS

BACKGROUND OF THE INVENTION

The present invention relates to combustion safety apparatus for preventing such danger as a lack of oxygen accident caused by incomplete combustion or unburned gas discharge caused by fire extinguishing.

With respect to apparatus of this kind, there has been heretofore known a type in which there are provided a switching element which is interposed in an electric power circuit for an electromagnetic valve interposed in a fuel passage and a combustion detecting element. The latter generates an electric change in response to such a change of a flame as caused by incomplete combustion or the like. The two elements are interconnected through a control circuit having a level detecting means which detects a predetermined level of the electric change of the combustion detecting element, so that by the predetermined level of the electric change of the combustion detecting element, the switching element may be opened to close the electromagnetic valve. It is usual with the detecting element of this apparatus that the same comprises an oxygen concentration cell element made of zirconia or the like which generates an electromotive force corresponding to an atmospheric oxygen concentration difference between electrodes provided on front and rear surfaces of an element body. It is also possible to use a variable resistance element made of titania or the like which generates a resistance change corresponding to an atmospheric oxygen concentration difference between the front and rear electrodes.

Either kind of those combustion detecting elements has such a defect that if the atmospheric oxygen concentration on the electrode brought in contact with a flame is changed by swaying of the flame caused by the wind or the like, it is so sensitive to the change thereof, that it generates almost the same electric change as in the case of incomplete combustion and thereby an unnecessary or unexpected closing of the electromagnetic valve results.

SUMMARY OF THE INVENTION

The present invention has the object to provide an apparatus free from that defect. In apparatus of that type, there are provided a switching element which is interposed in an electric power circuit for an electromagnetic valve interposed in a fuel passage, and a combustion detecting element which responds to such a change of a flame as is caused by incomplete combustion or the like and generates an electric change. These two elements are interconnected through a control circuit having a level detecting means which detects a predetermined level of the electric change of the detecting element so that the switching element may be opened by the foregoing predetermined level of the electric change of the detecting element. There is interposed in the control circuit a time limit operation circuit so that only where the generation of the electric change of the detecting element is continued for an operation delay time of the time limit operation circuit, the switching element may be opened.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
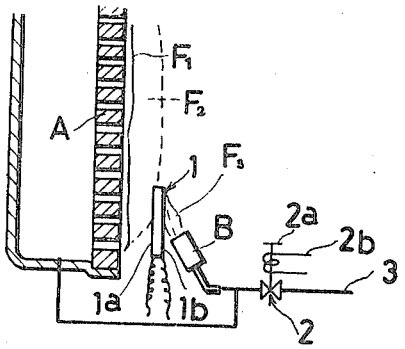
FIG. 1 is a schematic diagram showing one embodiment of a combustion apparatus according to the present invention.

Referring to the drawings, numeral 1 denotes a combustion detecting element of oxygen concentration cell type comprising an element body having on its front and rear surfaces respective electrods 1*a*, 1*b*. In the example shown in FIG. 1, the element 1 is disposed in relation to a combustion apparatus of such a normal combustion time output type that it generates an electromotive force at the time of normal combustion of the combustion apparatus.

More in detail, the combustion apparatus is provided with a main burner A and a standing burner B which are arranged to be supplied with gas through a fuel passage 3 having an electromagnetic valve 2 interposed therein. The element 1 is disposed in front of the main burner A with a space left therebetween, so that the electrode 1*a* on the front surface thereof is brought into contact with a flame of the main burner A when the flame is changed from its normal combustion flame $F_1$ to its incomplete combustion flame $F_2$. The electrode 1*b* on the rear surface thereof is so disposed as to be in contact with a flame $F_3$ of the standing burner B and consequently is always subjected to a comparatively low oxygen concentration atmosphere.

Thus, with this arrangement, at the time of normal combustion, there is produced a comparatively large oxygen concentration difference between the electrodes 1*a*, 1*b* on the front and rear surfaces of the combustion detecting element 1. As a result, there is generated in the element 1 an electromotive force corresponding to a large oxygen concentration difference. At the time of incomplete combustion, the electrode 1*a* on the front surface comes into contact with the incomplete combustion flame $F_2$, and as a result the oxygen concentration difference between the two electrodes 1*a*, 1*b* is decreased so that the electromotive force is lowered.

The element 1 is very high in its internal resistance at a normal temperature, so that the electromotive force is generated only where the element is decreased in its internal resistance by being heated to a predetermined operation temperature.

The electromagnetic valve 2 is comprised of a known safety valve which is opened by pushing an operation member 2*a* thereof and is kept in its open condition by energizing a solenoid 2*b* thereof. An electric power circuit 5 connected between the solenoid 2*b* and an electric power source 4 is provided with a switching element having a first transistor 6 interposed therein. The transistor 6 is connected to the foregoing combustion detecting element 1 through a control circuit 7.

Figure 2:
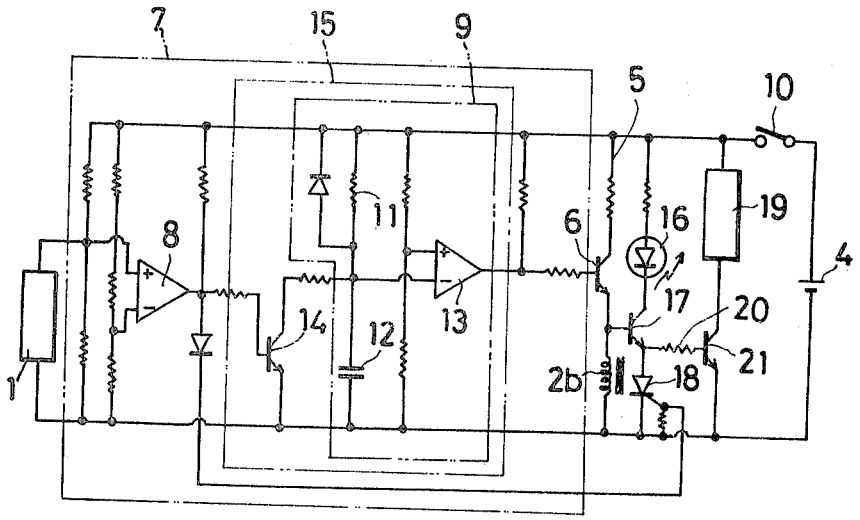
FIG. 2 is a circuit diagram of one embodiment in this apparatus.

More in detail, as shown in FIG. 2, the control circuit 7 is provided with a level detecting means comprising a first operational amplifier 8 which detects a level of the electromotive force of the element 1, and generates detection output of "0" when the level is lowered to a predetermined level determined by a bias voltage applied thereto. A timer circuit 9 is connected at its output terminal to the foregoing first transistor 6. The timer circuit 9 is provided with a condenser 12 which is to be charged through a resistance 11 when the electric power switch 10 interposed in the power circuit 5 is closed. A second operational amplifier 13 detects the charged potential of the condenser 12 and continues to generate an output of "1" as long as the detected charged potential is below a predetermined level determined by a bias voltage applied thereto. Thus, the first transistor 6 is closed by the output of "1" after a predetermined time interval from the instant when the power switch 10 is closed for the purpose of ignition, to the instant when condenser 12 has been charged to the predetermined level potential. This time interval of the timer is set so as to be somewhat longer than a pre-heat time length necessary for heating the detecting element 1 to the foregoing operation temperature. The electromagnetic valve 2 can be kept thereby, in its open condition for the pre-heat time length.

In the illustrated example, the output terminal of the first operational amplifier 8 is connected to the timer circuit 9 through a short-circuit switching element comprising a second transistor 14 which is in parallel with the condenser 12 and is arranged to be opened by the detection output of "0" of the amplifier 8. A time limit operation circuit 15 is thus formed by the second transistor 14 and the timer circuit 9. As described in detail hereinafter, this time limit operation circuit 15 operates in such a manner that the first transistor 6 is opened only where the electromotive force of the detecting element 1 is lowered to a predetermined level after the end of predetermined time length, and as a result the generation of the detection output of "0" from the amplifier 8 is continued for the predetermined time length.

The foregoing power switch 10 is arranged so as to be closed when the electromagnetic valve 2 is opened by the pushing operation of the operation member 2*a*.

Referring to the drawings, numeral 16 denotes a first indicator comprising a luminous diode or the like which is arranged to be energized through a third transistor 17. The latter is connected in an integrated Darlington circuit to the first transistor 6. A thyristor 18 is arranged to be controlled to open and close by the first operational amplifier 8. Reference numeral 19 denotes a second indicator comprising a buzzer or the like which is arranged to be energized through a fourth transistor 21 connected, in an integrated Darlington circuit, to the third transistor 17 through a resistance 20.

The operation of the foregoing arrangement is as follows:

First, the electromagnetic valve 2 is opened by operation of the member 2*a*, so that the main burner A and the standing burner B are supplied with gas and are ignited. Simultaneously with this operation, the power switch 10 is closed, so that the timer circuit 9 begins to operate. Thus, until the condenser 12 is charged to the predetermined potential, generation of the output of "1" from the second operational amplifier 13 is continued, and thereby the first transistor 6 is kept closed. The electromagnetic valve 2 is kept thereby in its open condition for the pre-heat time enough to heat the detecting element 1 to the operation temperature as mentioned before. During this time, a base current flows from the first transistor 6 to the fourth transistor 21 through the third transistor 17, and as a result the fourth transistor 21 is closed to operate the second indicator 19.

If the detecting element 1 is heated to the predetermined operation temperature within the pre-heat time and the electromotive force is generated, the output of "1" of the first operational amplifier 8 is generated. The second transistor 14 is thereby closed and consequently the charging operation to the condenser 12 of the timer circuit 9 is stopped. The condenser 12 is discharged to its lower charged potential. Thereafter, the generation of the output of "1" from the second operational amplifier 13 of the timer circuit 9 is continued. The closed condition of the first transistor 6, and accordingly, the open condition of the electromagnetic valve 2 is continued. Under this condition, the thyristor 18 becomes conductive by the output of "1" of the first operational amplifier 8 so that the first indicator 16 is operated. In the meantime the base potential of the fourth transistor 21 is lowered to stop the operation of the second indicator 19.

If, next, the main burner A is changed into its incomplete combustion condition for one reason or another, for instance, lack of oxygen in the atmosphere or the like, the front surface electrode 1*a* of the detecting element 1 is brought into contact with the incomplete combustion frame $F_2$ so that the electromotive force of the element 1 is lowered. If the electromotive force becomes below the predetermined level, the detection output of "0" is generated from the first operational amplifier 8. With this output, the electromagnetic valve 2 is closed with the lapse of the predetermined operation delay time caused by the operation of the time limit operation circuit 15 comprising the second transistor 14 and the timer circuit 9. Namely, by the detection output of "0" from the first operational amplifier 8, the second transistor 14 is opened. The discharging from the condenser 12 is thereby stopped and charging of the condenser 12 through the resistance 11 is started. With the end of the operation delay time extending from a time instant when the charging to the condenser 12 starts to a time instant where the condenser 12 has been charged to the predetermined potential, and the output of the second operational amplifier 13 has been changed thereby to that of "0", the first transistor 6 is opened to close the electromagnetic valve 2.

If, in the case of normal combustion, the flame $F_3$ of the standing burner B is so swayed for a moment by the influence of the wind or the like as to be separated off the rear surface electrode 1*b* of the element 1, the oxygen concentration in the atmosphere on the electrode 1*b* is increased, so that the oxygen concentration difference between the two electrodes 1*a*, 1*b* is decreased and consequently the electromotive force of the element 1 is lowered for a moment. On this occasion, the time limit operation circuit 15 begins to operate in almost the same manner as above. In this case, however, before the end of the foregoing time limit operation delay time, the electromotive force of the element 1 is again increased and consequently the output of the first operational amplifier 8 is restored to that of "1". The second transistor 14 is thereby closed and the discharging of the condenser 12 is resumed, so that closing of the electromagnetic valve 2 is not brought about.

In the foregoing example, the time limit operation circuit 15 is constructed by utilizing the timer circuit 9 which serves to maintain opening of the electromagnetic valve 2 for the pre-heat time necessary for the element 1. The circuit is arranged so that the electromagnetic valve 2 is closed only where generation of the detecting output of "0" from the first operational amplifier 8 is continued for the predetermined time. However, such a modification can be considered whereby time limit operation is performed in such a manner that the detection output of "0" is generated from the amplifier 8 only where lowering of the electromotive force of the detecting element 1 below a predetermined level is continued for a predetermined time.

Figure 3:
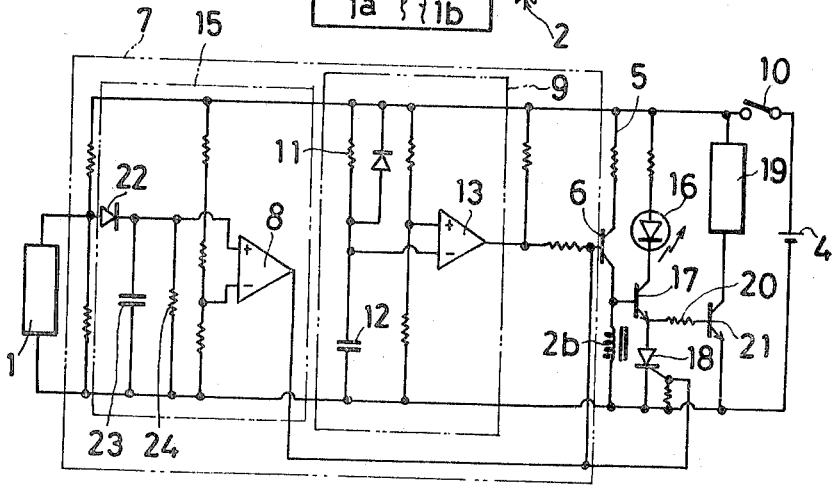
FIG. 3 is a circuit diagram of another embodiment in the apparatus.

Such a modified embodiment, as above, is shown in FIG. 3. In this example, the output terminal of the first operational amplifier 8 is connected directly to the first transistor 6 without passing through the timer circuit 9, and a time constant circuit which comprises a condenser 23 and a resistance 24 connected in parallel therewith, and is connected through a diode 22 to the detecting element 1. The time constant circuit is connected to the input terminal of the amplifier 8, and thus the time limit operation circuit 15 is formed by the time constant circuit and the amplifier 8.

If, with this arrangement, the electromotive force of the detecting element 1 is lowered, the charge potential of the condenser 23 previously charged through the diode 22 by the electromotive force of the element 1 is discharged through the resistance 24 at the predetermined time constant. If the charged potential thereof is lowered to the predetermined level determined by a bias voltage applied to the amplifier 8 with the end of a predetermined operation delay time and consequently the detection output of "0" is generated from the amplifier 8, then the first transistor 6 is opened to close the electromagnetic valve 2.

Accordingly, if the electromagnetic force of the element 1 is lowered for a moment by swaying of the flame or the like, the electromotive force of the element 1 is again increased, so that the charging of the condenser 23 resumes before the end of the predetermined delay time, and the electromagnetic valve 2 is not closed. The remainder of the operation of this embodiment is the same as in the foregoing embodiment.

In the foregoing embodiments, there has been described a case where the combustion detecting element 1 is an oxygen concentration cell element made of zirconia or the like and is also disposed so as to become normal combustion time output type one. The present invention, however, is not limited thereto and such a modified case can be considered that the element is disposed so as to become an incomplete combustion time output type one and/or the element is comprised of a variable resistance element made of titania or the like. Thus, in any case, it is sufficient if an electric change of the element is brought about by any change of a flame condition caused at the time of incomplete combustion or the like.

Thus, according to the present invention, the control circuit connected between the combustion detecting element and the switching element which is interposed in the electric power circuit for the electromagnetic valve, is provided with the time limit operation circuit interposed therein. The switching element may be thereby opened to close the electromagnetic valve only where an electric change of the detecting element is generated continuously for the predetermined operation delay time of the time limit operation circuit. The electromagnetic valve consequently remains open even if the electric change of the detecting element is for a moment made by swaying of a flame or the like, so that unnecessary or unexpected closing of the valve can be eliminated.

Without further analysis, the foregoing will so fully reveal the gist of the present invention that the invention can, by applying current knowledge, be readily adapted for various applications without omitting features that, from the stand point of prior art, constitute essential characteristics of the generic or specific aspects of this invention, and therefore, such adaptations should and are intended to be comprehended within the meaning and range of equivalence of the following claims.

What we claim is:

1. Combustion safety apparatus comprising: electric power circuit means for an electromagnetic valve in a fuel passage; a switching element in said power circuit means; a combustion detecting element responding to a change of a flame caused by incomplete combustion or the like and generating a change in an electrical characteristic; a control circuit having level detecting means for detecting a predetermined level of said change; said two elements being interconnected through said control circuit so that said switching element may be opened by said predetermined level of change of detecting element; a time limit operation circuit in said control circuit and arranged so that said switching element may be opened only when the generation of the change of the detecting element is continued for the entire delay time of the time limit operation; and a timer circuit with a condenser arranged to be charged through a resistance means by closing a power switch in the electric power circuit, said timer circuit being connected at its output terminal to said switching element so that said timer circuit has an output until the condenser is charged to a predetermined potential whereby the switching element is kept in a closed condition for a time necessary to pre-heat said detecting element.

2. Combustion safety apparatus as defined in claim 1, including a short-circuit switching element connected in parallel with said condenser; an output terminal of said level detecting means being connected to said timer circuit through said short-circuit switching element; said short-circuit switching element being arranged to be opened by the detection output of said level detecting means, said time limit operation circuit being comprised of said short-circuit switching element and said timer circuit.

3. Combustion safety apparatus as defined in claim 1, wherein said level detecting means has an output terminal connected directly to said switching element so that said switching element may be opened by the detection output of said level detecting means, said level detecting means having an input terminal connected to a time constant circuit connected through a diode to said detecting element; said time limit operation circuit being comprised of the time constant circuit and said level detecting means.

4. Combustion safety apparatus as defined in claim 1 wherein:

the delay time provided by said time limit operation circuit is shorter than the delay time provided by said timer circuit.

* * * * *